United States Patent [19]

Metcalf

[11] Patent Number: 4,967,663

[45] Date of Patent: Nov. 6, 1990

[54] UNENGRAVED METERING ROLL OF POROUS CERAMIC

[75] Inventor: Robert L. Metcalf, Beaverton, Oreg.

[73] Assignee: Coors Porcelain Company, Golden, Colo.

[21] Appl. No.: 261,342

[22] Filed: Oct. 24, 1988

[51] Int. Cl.[5] ..... B41F 1/46

[52] U.S. Cl. ..... 101/348; 101/36; 29/132

[58] Field of Search ..... 101/348–350, 101/375, 216, 36; 29/132, 690, 719; 401/197; 501/80

[56] References Cited

U.S. PATENT DOCUMENTS

| | | | |
|---|---|---|---|
| 3,264,720 | 8/1966 | Mott | 29/183.5 |
| 3,613,578 | 10/1971 | Heurich | 101/350 |
| 3,942,230 | 3/1976 | Nalband | 29/132 |
| 4,009,658 | 3/1977 | Heurich | 101/348 |
| 4,084,500 | 4/1978 | Brown et al. | 101/28 |
| 4,137,106 | 1/1979 | Doi et al. | 148/126 |
| 4,198,739 | 4/1980 | Budinger et al. | 29/132 |
| 4,242,782 | 6/1981 | Hanneken et al. | 29/129 |
| 4,301,730 | 11/1981 | Heurich et al. | 101/348 |
| 4,458,399 | 7/1984 | Kessler | 29/148.4 D |

FOREIGN PATENT DOCUMENTS

| | | | |
|---|---|---|---|
| 104782 | 5/1987 | Japan | 101/348 |

OTHER PUBLICATIONS

Article, "Laser-Engraved Anilox Rolls Offer Accuracy, Uniformity," by C. R. Heurich, published by Pamarco, Inc., of Roselle, N.J.

Article, "Ceramic Foam Offers Surprising Properties," by Jerry Brockmeyer and Joseph F. Pizzirusso, P.E.

*Primary Examiner*—Edgar S. Burr
*Assistant Examiner*—Ren Yan
*Attorney, Agent, or Firm*—Klarquist, Sparkman, Campbell, Leigh, & Whinston

[57] ABSTRACT

An unengraved metering roll made of porous ceramic material is described for depositing measured amounts of liquid as a coating on a substrate such as a metal can. The coating liquid is contained within the pores of the ceramic roll and deposited upon the object or a transfer roll without the use of metering cells which are ordinarily provided by engraving a pattern on the outer surface of the roll. The pores are of a substantially uniform size and are distributed substantially uniformly throughout the ceramic roll. The metering roll of porous ceramic material may be more easily resurfaced merely by grinding in a conventional manner to remove the original outer surface and replacing it with a new outer surface having pores which open to such outer surface for receipt of the coating liquid. The size of the pores and the amount of such pores in the ceramic body are controlled by mixing organic filler particles with the ceramic base material before firing so that such organic particles are burned out during heating of the molded roll body prior to sintering of the ceramic particles to form the porous ceramic roll. In this manner, the size and distribution of the particles can be controlled to match the characteristics of the coating liquid for which the roll is to be used.

20 Claims, 1 Drawing Sheet

UNENGRAVED METERING ROLL OF POROUS CERAMIC

BACKGROUND OF INVENTION

The present invention relates generally to metering rolls for depositing measured amounts of liquid as a coating on a substrate and, in particular, to metering rolls used for depositing printing ink, protective varnish, or other coating liquid onto moving objects such as metal cans.

It has previously been known to provide metering rolls in the form of a cylindrical metal roll which is mechanically engraved to form a plurality of spaced liquid-container depressions or cells in the outer surface of such roll as a fine pattern of, for example, 250 to 600 cells per inch having a depth of about 12 microns. The metering roll deposits a measured amount of ink or other coating liquid contained in such cells directly on the object to be coated or on an intermediate printing roll which transfers the coating liquid onto such object. In order to improve the wear characteristics of such engraved metal metering rolls, it has been previously proposed to provide a thin chromium plating over the engraved surface of the metal roll which plating is of a greater hardness and, therefore, increases the time between surface refinishing. An example of such an engraved chrome-plated metal metering roll is found in U.S. Pat. No. 3,613,578 of C. R. Heurich issued Oct. 19, 1971. Unfortunately, such finely engraved metal metering rolls still have a short life, due to rapid wear and corrosion, which requires that the surface of the roll be refinished frequently by a complicated and expensive engraving process. This refinishing can only be done by expert engravers and takes a considerable amount of the time to accomplish.

It has also been proposed to provide a plasma flame-sprayed ceramic coating over the engraved surface of a metal metering roll to provide an improved wear surface for such roll as shown in U.S. Pat. No. 4,009,658 of C. R. Heurich, issued Mar. 1, 1977. Unfortunately, such ceramic coating largely fills the engraved depressions or metering cells on the surface of the roll so that the capacity of such cells is only on the order of about one-fifth the volume of the uncoated cell. In addition, the flame-sprayed ceramic coating is deposited in a nonuniform manner with random-sized pores and varying density so that the thickness of such coating varies, which causes the shape of the metering cells to vary in an unpredictable fashion. As a result, the engraved pattern cannot be as fine and is limited to about 90 cells per inch maximum. Another problem with such flame-spray ceramic coated engraved metal metering rolls is that the ceramic coating must be thin and in some locations is permeable to the coating liquid which may be highly corrosive to the underlying metal roll. In these cases, the corrosive ink or other coating liquid attacks the interface between the metal roll and the ceramic coating, thereby separating the coating in places which requires refinishing.

Attempts have been made to solve the corrosion problem associated with flame-sprayed, ceramic-coated, engraved metal metering rolls by providing a resin sealing material in the pores of the ceramic coating. This prevents the corrosive ink or other liquid from being transmitted through the ceramic coating to its interface with the metal roll, as shown in U.S. Pat. No. 4,301,730 of C. R. Heurich and W. A. Runck, issued Nov. 24, 1981. It has also been proposed to provide a film of Teflon plastic over a porous flame-sprayed ceramic coating on a metal roll used in the manufacture of paper, as shown in U.S. Pat. No. 3,942,230 of T. E. Nalband, issued Mar. 9, 1976.

A more recent development is the use of a laser beam to engrave the surface of a ceramic-coated metal metering roll to provide the liquid containing depressions or cells on the surface of such roll after the flame-sprayed ceramic coating is deposited. However, this has the disadvantage that it requires computer-controlled laser equipment which is extremely expensive. In this regard, see the article entitled "Laser-Engraved Anilox Rolls Offer Accuracy, Uniformity," by C. R. Heurich, published by Pamarco, Inc., of Roselle, N.J. This laser engraved ceramic surface is also used by Union Carbide for their "Ucarlox" brand metering rolls.

All of the above-identified prior metering rolls have the common disadvantage that the coating liquid containing depressions or metering cells must be formed by engraving a pattern on the surface of the roll and such engraved surface requires periodic refinishing. This surface refinishing involves mechanically engraving or laser etching a fine pattern of cells at a considerable cost and resulting delay in the use of such rolls. The present invention overcomes these disadvantages by eliminating the need for such engraved surface and instead using as the metering cells the pores of an unengraved metering roll made of porous ceramic material. The porous ceramic material is made in a controlled manner to have pores of substantially uniform, predetermined size distributed substantially uniformly in a predetermined amount throughout such roll. As a result, when the present metering roll needs to be refinished, its outer surface is simply ground to remove the old surface layer, thereby exposing the pores of the porous ceramic material in a new surface layer. Then the resurfaced roll is put back into service without the need for any engraving or etching. This can be done by unskilled labor on site at the user's plant with conventional grinding equipment in a short period of time with resulting cost advantages to the user.

The pores of the porous ceramic material for the present metering roll may be formed by providing filler particles of organic material of a predetermined size which are mixed in a predetermined amount throughout the ceramic base material before molding the roll body. Then, when the roll body of green ceramic material is heated to sinter the ceramic particles together at high temperature, the organic filler particles are burned out at a lower temperature, leaving pores of a predetermined, substantially uniform size and substantially uniform distribution. Thus, the size of the pores can be controlled and varied over a wide range, such as 3 to 100 microns, depending upon the coating liquid which is to be deposited by such metering roll. For example, when depositing a film of coating liquid or printing ink containing a large amount of solvent which evaporates, pores of larger size would be used so that after evaporation of the solvent the deposited coating is of the desired thickness. However, in depositing a thin film of coating liquid which employs mostly solids and only a small amount of such solvent, smaller pores can be employed. Thus, the pore size and distribution may be controlled by changing the size of the organic filler particles and the amount of such filler particles mixed with the ceramic base material used in forming the porous ceramic roll.

SUMMARY OF INVENTION

It is, therefore, one object of the present invention to provide an improved metering roll of greater wear resistance and longer useful life made of porous ceramic whose outer surface is not engraved or otherwise provided with surface depressions for containing the coating liquid but which uses the pores in the ceramic roll body for containing the coating liquid.

Another object of the present invention is to provide such a metering roll with a porous ceramic roll body whose pores are of a substantially uniform size and are distributed substantially uniformly throughout the ceramic body.

A further object of the invention is to provide such a metering roll in which the outer surface of the ceramic roll body may be refinished merely by grinding without the need for subsequent engraving so that such refinishing can be accomplished inexpensively and rapidly.

An additional object of the invention is to provide such a metering roll in which the ceramic roll body is supported on the roll shaft by end plates of ceramic material similar to that of such roll body so that they have substantially the same thermal expansion characteristics as such body.

Still another object of the invention is to provide such a metering roll in which the pores in the ceramic material are provided of a predetermined size and a predetermined amount which may be adjusted in a controllable manner by using organic filler particles of a selected size which are mixed throughout the ceramic base material in a selected amount before firing to sinter the ceramic particles together after burning out the organic filler particles.

A still further object of the invention is to provide such a metering roll with wear plates of a more wear-resistant ceramic material than the porous ceramic roll body on the opposite ends of the roll body so that such wear plates enable doctoring of the outer surface of the ceramic roll by an external doctor blade to remove unwanted coating liquid without causing undue wear of the roll body.

DESCRIPTION OF DRAWINGS

Other objects and advantages of the present invention will be apparent from the following detailed description of a preferred embodiment thereof and from the attached drawings of which.

DESCRIPTION OF PREFERRED EMBODIMENTS

Figure 2:
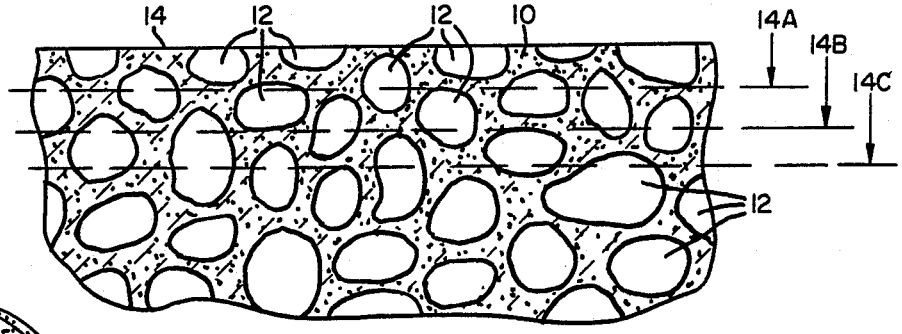
FIG. 2 is an enlarged partial section view taken along the line 2—2 of FIG. 1 showing a portion of the outer surface of the porous ceramic metering roll body.
Figure 1:
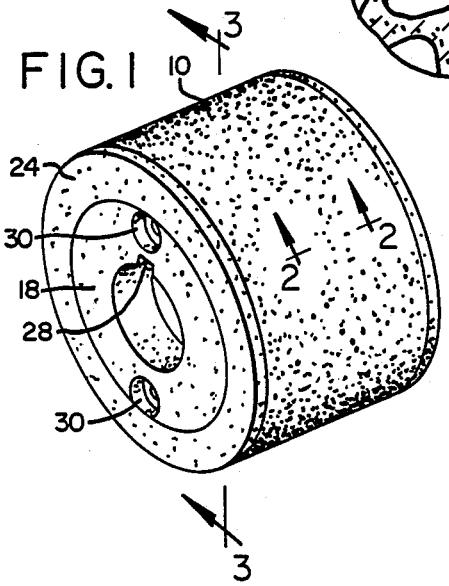
FIG. 1 is an oblique elevation view of a metering roll made in accordance with one embodiment of the present invention.
Figure 3:
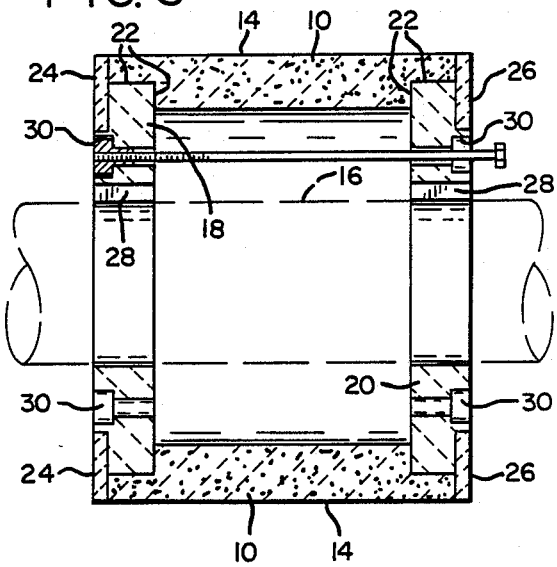
FIG. 3 is a vertical section view taken along the line 3—3 of FIG. 1.

One embodiment of the metering roll of the present invention is shown in FIGS. 1, 2, and 3 and includes a roll body 10 of porous ceramic material such as aluminum oxide ceramic. The metering roll body 10 may be about 1.0 inch thick and contains a plurality of pores 12 of substantially uniform size preferably in the range of approximately 3 to 100 microns in diameter which are distributed substantially uniformly throughout the porous ceramic body to provide a solid structure of about 20 to 80 percent. The pores 12 communicate with each other and include an outer layer of pores which opens onto the outer surface 14 of the roll so that they serve as reservoirs for the coating liquid being transmitted from the metering roll. Thus, the coating liquid is held within an outer layer of pores 12 which open on the outer surface of the roll as well as in those interior pores which communicate with such open pores. The outer surface 14 of the metering roll body 10 is an even cylindrical surface which is free of any depressions and is unengraved. That is, the outer surface 14 has no engraved pattern metering cells or any other pattern of depressions created by external engraving means, including laser beam engraving or mechanical engraving.

Rather than employing metering cells created by engraving to hold the coating liquid, such liquid is, instead, held within the pores 12 of the ceramic body 10. This has the advantage that when the original outer surface 14 becomes worn, dirty or otherwise rendered unusable, it is a simple matter to resurface the metering roll by merely grinding the outer surface away to a lower surface level 14A as shown in FIG. 2. As a result, a new outer surface is created with a new set of open pores 12 opening to such outer surface which function as the primary containers of the coating liquid. This resurfacing can be done several times during the life of the roll by grinding away the worn surface of the roll to provide subsequent outer layers 14B, 14C, etc. The amount of pores provided in the metering roll varies, but is typically sufficient to provide a solid structure in the metering roll of about 20 to 80 percent with the remaining percent being pores or voids. In one example, the porous ceramic metering roll 10 was provided with a solid structure of 65 to 70 percent and a porosity of 35 to 30 percent when 20 parts by weight of organic filler particles were mixed with 100 parts of ceramic base material and molded by press forming, into a cylinder before firing to create the porous sintered ceramic roll. In another example, the porous ceramic had a solid material content of 55 to 60 percent and a porosity of 45 to 40 percent when an organic filler material of about 30 parts was added to 100 parts of ceramic base material. In both cases, the average majority pore size was approximately 10 microns in diameter which is significantly greater and may be more than three times the diameter size of the particles of ceramic material which are sintered together, such pores being produced by using organic filler particles in the form of walnut shell flour passing through a screen of 325 mesh size. However, it is possible to provide the pores 12 of different selected sizes such as, for example, in the range of 3 to 100 microns, depending upon the type of coating liquid sought to be held and dispensed from the metering roll. In addition, it is possible to add more of the organic filler material to the ceramic base material and thereby increase the porosity and reduce the solid content of the porous ceramic body 10 to less than 50 percent solid structure down to, for example, as low as 10 percent structure. However, at lower solid structure percentages, the roll is not as strong and may require a backing support of ceramic or metal such as the metal drum used in the embodiment of FIGS. 4 and 5 hereafter discussed.

The porous ceramic roll 10 is supported for rotation on a metal shaft 16 by end plates 18 and 20 approximately 1.0 inch thick made of a similar ceramic material to that of the roll 10 so that such end plates have substantially the same thermal expansion coefficients as such roll. For example, when the porous ceramic roll 10 is made of aluminum oxide ceramic ($Al_2O_3$), the end plates 18 and 20 may be made of the same $Al_2O_3$ ceramic material but of a higher density, such as approximately 95 to 97 percent of its maximum theoretical density for greater strength. The ceramic roll body 10 is secured to the end plates 18 and 20 at shoulders 22 by a suitable adhesive bonding material such as room-temperature curing epoxy resin.

In addition, it has been found desirable to mount wear plates 24 and 26 of more wear-resistant ceramic material, such as high density zirconium oxide, on opposite sides of the metering roll so that such wear plates extend substantially even with or slightly above the outer surface 14 of the porous ceramic roll 10. These wear plates protect the outer surface of the porous ceramic roll 10 from undue wear, such as when it engages a doctor blade for removing excess coating liquid from such surface. The wear plates 24 and 26 are in the form of annular rings approximately 3/16 inch thick which are bonded to the sides of the end plates 18 and 20 and to the opposite ends of the porous ceramic roll 10 by a suitable adhesive bonding material such as room-temperature curing epoxy resin.

The end plates 18 and 20 supporting the metering roll may each be provided with a keyway 28 which engages a key inserted into a groove in the shaft 16 to hold such metering roll on the shaft and cause it to rotate with such shaft. In addition, threaded metal inserts 30 may be bonded in mounting holes in each of the ceramic end plates 18 and 20 for threadedly engaging pull rods which enable the metering roll to be pulled off of the shaft in either direction.

Method of Manufacture

The following steps may be used in the method of manufacture of the metering roll of the present invention.

Step 1. Wet grind calcined aluminum oxide base material and any additives for making the ceramic material in a ball mill to particles of the desired size on the order of about an average diameter of 2 to 3 microns.

Step 2. Mix the ground ceramic base material with organic binder, such as carbowax, and organic filler particles such as walnut shell flour having a particle size passing through a 325 line mesh. The walnut shell flour is added at an amount of between 20 and 30 percent of the ceramic base material. Thus, 20 percent added walnut flour provides a final ceramic body which is approximately 35 to 30 percent porous and 65 to 70 percent solid structure, while the 30 percent added walnut flour provides a final porous ceramic body of 45 to 40 percent pores and 55 to 60 percent solid structure.

Step 3. The mixture of aluminum oxide ceramic base material, organic binder, and walnut shell flour is then spray dried to produce spherical particles of mixture material.

Step 4. The mixture particles are then poured into a mold which is placed in an isostatic press in order to mold by press forming the molding material into a hollow, circular cylinder body which eventually forms the metering roll.

Step 5. The cylinder body produced by the isostatic press step is machined while it is in a green ceramic or unfired state to the approximate correct size of the final cylindrical roll but allowing for shrinkage in the final firing step.

Step 6. The machined cylinder body of green ceramic material is then fired by placing it in a furnace which gradually heats the body from room temperature to 300° C. at a rate of approximately 50° C. per hour and holds the body at this 300° temperature for approximately 2½ hours in order to burn out all organic binder and walnut particles. Then the temperature is increased from 300° C. to a maximum of 1640° C. in steps of approximately 75° C. per hour. The body is then held at the maximum temperature of 1640° C. for approximately two to three hours in order to completely sinter the aluminum oxide ceramic particles together to form the sintered porous ceramic cylinder. When sintering is complete, the temperature of the sintered ceramic body is reduced from 1640° C. to room temperature at a rate of approximately 100° C. per hour.

The sintering step causes the ceramic body to shrink approximately 16 percent, including the pores in such ceramic body. This is taken into account so that the average majority pore size of the final sintered ceramic body is approximately 10 microns which is over three times the average particle size of two to three microns diameter for the particles of ceramic material which are sintered together, in the example given above. However, it should be noted that this pore size can be adjusted for different inks or other coating liquids, depending upon how much solvent they employ. Typically, such average pore size can be controlled in a range from 100 microns to as low as 3 microns by changing the size of the walnut shell particles.

Step 7. The sintered ceramic metering roll body is ground on its outer surface to the final outer diameter dimensions which, in the preferred embodiment, is approximately 8.000 to 8.010 inch diameter.

Step 8. Then the porous ceramic metering roll 10 is assembled by bonding it to the aluminum oxide support end plates 18, 20 and to the zirconium oxide ceramic wear plates 24, 26 by any suitable adhesive bonding material such as room-temperature curing epoxy resin.

Figure 4:
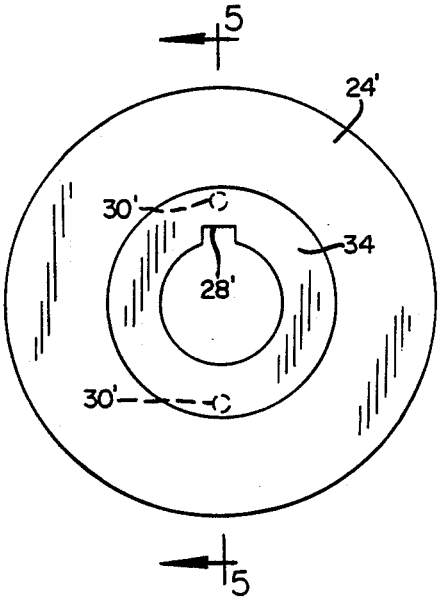
FIG. 4 is an elevation view of the end of a second embodiment of the metering roll of the present invention taken along the line 4—4 of FIG. 5.
Figure 5:
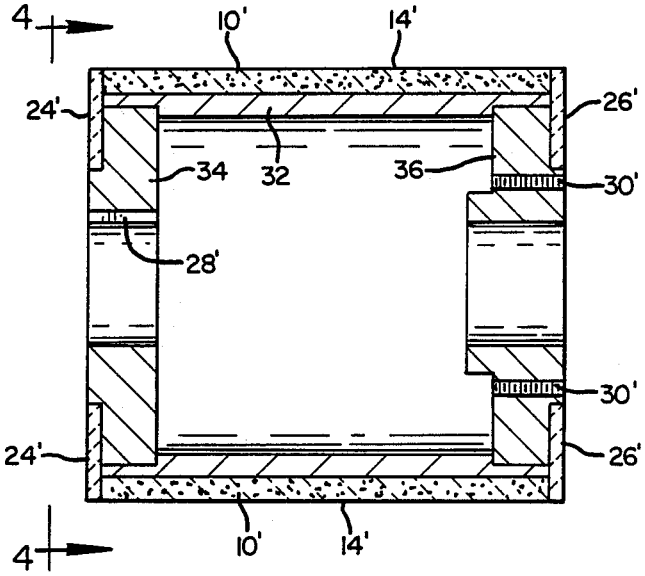
FIG. 5 is a vertical section view taken along the line 5—5 of FIG. 4.

A second embodiment of the metering roll of the present invention is shown in FIGS. 4 and 5 which includes a porous ceramic roll body 10' similar to the body 10 of the previously-described embodiment of FIGS. 1, 2, and 3 but of a reduced thickness. The ceramic roll body 10' is secured to a metal support drum 32 in any suitable manner such as by room-temperature curing epoxy resin. The metal drum is secured to metal end plates 34 and 36 in any suitable manner such as by welding. The ceramic roll body 10' is made of a porous ceramic material similar to that of body 10 of FIGS. 1, 2, and 3 except that it is of lesser thickness of say, for example, ⅜ inch thick versus a thickness of, for example, 1 inch thick for the roll body 10. However, it should be noted that even porous ceramic roll body 10' is a self-supporting body and is not a coating of ceramic material on the metal drum support 32. The ceramic roll body 10' is provided with an even cylindrical outer surface 14' and contains pores of substantially uniform size distributed substantially uniformly throughout such body, some of which are open to such outer surface in a similar manner to that described above with respect to FIG. 2. Otherwise, the metering roll of the embodiment of FIGS. 4 and 5 is substantially the same as that of the embodiment of FIGS. 1, 2, and 3 and the same reference numbers have been used in the drawings to designate like parts except for the adding of a prime to such numbers.

It will be apparent to those having ordinary skill in the art that many changes may be made in the above-described preferred embodiments of the present invention without departing from the spirit of the invention. For example, other ceramic materials than aluminum oxide and zirconium oxide may be employed for the ceramic roll body 10 and 10' and for the support end plates 18 and 20 and for the wear plates 24 and 26. Therefore, the scope of the present invention should be determined by the following claims.

I claim:

1. A metering roll device for depositing a thin coating of liquid on a workpiece, comprising:

a roll member with at least a portion thereof made of porous sintered ceramic material having pores of a substantially uniform size distributed substantially uniformly throughout said roll portion, said pores being of a size significantly greater than the average size of the particles of ceramic material which are sintered together to form the roll member, at least some of such pores opening to the outer surface of the roll member, said roll member having a substantially even cylindrical outer surface free of depressions larger than said pores, and the pores being of a size so that the coating liquid is held on the roll member primarily in said pores, and said roll is rechargeable with coating liquid; and support means for supporting said roll member for rotation about a roll axis.

2. A device in accordance with claim 1 in which the roll member of porous ceramic material is a self-supporting body of ceramic with the pore size being at least twice the size of the particles of ceramic material.

3. A device in accordance with claim 2 in which the ceramic material is made of sintered ceramic particles of an average size less than 40 microns and has a solid structure of about 50 to 70 percent.

4. A device in accordance with claim 3 in which the majority of the pores are of a size in a range of about 3 to 100 microns.

5. A device in accordance with claim 1 in which the porous ceramic material is aluminum oxide ceramic.

6. A device in accordance with claim 1 which also includes mounting means for releasably mounting said roll member.

7. A device in accordance with claim 1 in which the support means has substantially the same thermal expansion characteristics as that of the roll member.

8. A device in accordance with claim 7 in which the support means are a pair of end plates of ceramic material which is made of substantially the same chemical elements as that of said roll member.

9. A device in accordance with claim 1 which also includes a pair of wear plates of another ceramic material secured to the opposite sides of said roll member and extends to the outer surface of said roll member, said other ceramic material being of higher density and higher wear-resistance than said porous ceramic material.

10. A device in accordance with claim 9 in which the high density ceramic material is zirconium oxide and the wear plates are bonded to the roll member by an adhesive.

11. A device in accordance with claim 1 in which the support means includes a metal support drum and the roll member is attached to the outer surface of such drum.

12. A device in accordance with claim 11 in which the roll member is bonded to the drum by an adhesive bonding material.

13. A device in accordance with claim 12 in which the bonding material is an epoxy resin.

14. In a metal can coating machine, an unengraved metering roll device for depositing a thin coating of liquid on metal cans, said roll device comprising:

a roll member including a self-supporting body of porous sintered ceramic material having pores of a predetermined size significantly greater than the size of the particles of ceramic material which are sintered together, distributed throughout said body and having a substantially even cylindrical outer surface which is unengraved and free of depressions larger than said pores, said pores being of a size so that the coating liquid is held on the roll member primarily in said pores; and support means for supporting said roll member for rotation about a roll axis.

15. A device in accordance with claim 14 in which the ceramic body is made of sintered ceramic particles with a pore size at least twice the size of the particles of ceramic material and has a solid structure of about 50 to 70 percent.

16. A device in accordance with claim 15 in which the majority of pores are of a size in a range of about 3 to 100 microns.

17. A device in accordance with claim 14 in which the porous ceramic material is aluminum oxide ceramic.

18. A device in accordance with claim 14 in which the support means has substantially the same thermal expansion characteristics as that of the roll member.

19. A device in accordance with claim 18 in which the support means are a pair of end plates of ceramic material which is made of substantially the same chemical elements as that of said roll member.

20. A device in accordance with claim 14 which also includes a pair of wear plates of another ceramic material secured to the opposite sides of said roll member and extends to the outer surface of said roll member, said other ceramic material being of higher density and higher wear-resistance than said porous ceramic material.

* * * * *